US005996707A

United States Patent [19]

Thome et al.

[11] Patent Number: 5,996,707

[45] Date of Patent: Dec. 7, 1999

[54] HAND POWER TOOL

[75] Inventors: Ludwig Thome; Karl Frauhammer; Manfred Hellbach, all of Leinfelden-Echterdingen; Gerhard Meixner, Filderstadt; Heinz Schnerring, Dettenhausen; Manfred Klein, Owen, all of Germany

[73] Assignee: Robert Bosch GmbH, Stuttgart, Germany

[21] Appl. No.: 08/740,363

[22] Filed: Oct. 28, 1996

[30] Foreign Application Priority Data

Nov. 2, 1995 [DE] Germany ..... 195 40 718

[51] Int. Cl.[6] ..... B25F 5/00

[52] U.S. Cl. ..... 173/2; 173/176; 173/217; 173/171

[58] Field of Search ..... 173/104, 109, 173/200, 201, 217, 176, 48, 213, 117, 20, 2, 171

[56] References Cited

U.S. PATENT DOCUMENTS

| | | | |
|---|---|---|---|
| 3,454,111 | 7/1969 | Neiss | 173/176 |
| 4,029,159 | 6/1977 | Nymann | 173/217 |
| 4,448,261 | 5/1984 | Kousek et al. | 173/176 |
| 5,085,280 | 2/1992 | Rassieur | 173/176 |
| 5,401,124 | 3/1995 | Hettich | 173/176 |
| 5,704,435 | 1/1998 | Meyer et al. | 173/176 |

FOREIGN PATENT DOCUMENTS

4300021A1 7/1994 Germany .

*Primary Examiner*—Scott A. Smith
*Attorney, Agent, or Firm*—Michael J. Striker

[57] ABSTRACT

A hand power tool has a machine housing, a drive motor accommodated in the machine housing, a drive train connected with the drive motor and provided with a tool receptacle for rotation of a tool insertable in the tool receptacle, a detecting device for detecting an uncontrolled operation of the hand power tool by detecting a blocking of the tool in a workpiece with a resulting impact-like turning of the machine housing, a blocking device provided for the drive train and releasable by the detecting device, the locking device having a locking toothing arranged in the drive train and a blocking member movably supported in the machine housing and form-lockingly engagable in the locking toothing so as to non-rotatably fix the drive train relative to the machine housing, the detecting device being formed so that it produces an electrical release signal in an uncontrolled operation, the blocking device being releasable by the electrical release signal, and further has electromagnet device actuatable by the release signal so that the locking member is engagable by the electromagnet device into the locking toothing.

18 Claims, 3 Drawing Sheets

HAND POWER TOOL

BACKGROUND OF THE INVENTION

The present invention relates generally to hand power tools.

More particularly, it relates to a hand power tool which has a machine housing, a drive motor arranged in the housing, a drive strand connecting the drive motor with a tool receptacle for rotation of a tool inserted in the tool receptacle, and a detection device for detecting an uncontrolled operation of the hand power tool.

Hand power tools of the above mentioned general type are known in the art. One of such hand power tools is disclosed in the German patent document DE 43 00 021 A1. The drive spindle in this hand power tool is blocked in an impact-like manner when the machine housing unintentionally starts to rotate. For releasing the blocking process, a mass member guided displaceably in the machine housing is provided. In the case of blocking, it releases a locking member for engagement in a toothing of the drive spindle. This solution has the disadvantage that the mass member always causes vibrations as a result of the operation, and moreover gravitation action is caused by the operation, so that in an unfavorable operational positions, only a relatively inaccurate and late release of the blocking device is possible.

SUMMARY OF THE INVENTION

Accordingly, it is an object of the present invention to provide a hand power tool, which avoids the disadvantages of the prior art.

In keeping with these objects and with others which will become apparent hereinafter, one feature of the present invention resides, briefly stated, in a hand machine tool in which the detection device for detecting an electrical release signal in uncontrolled blocking case is formed so that the blocking device is releasable by an electrical release signal and the locking member is engageable directly or indirectly into the locking toothing by an electromagnet actuated by the release signal.

When the hand power tool is designed in accordance with the present invention, it has the advantage that an almost delay-free blocking release which is free from undesirable influences is guaranteed.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
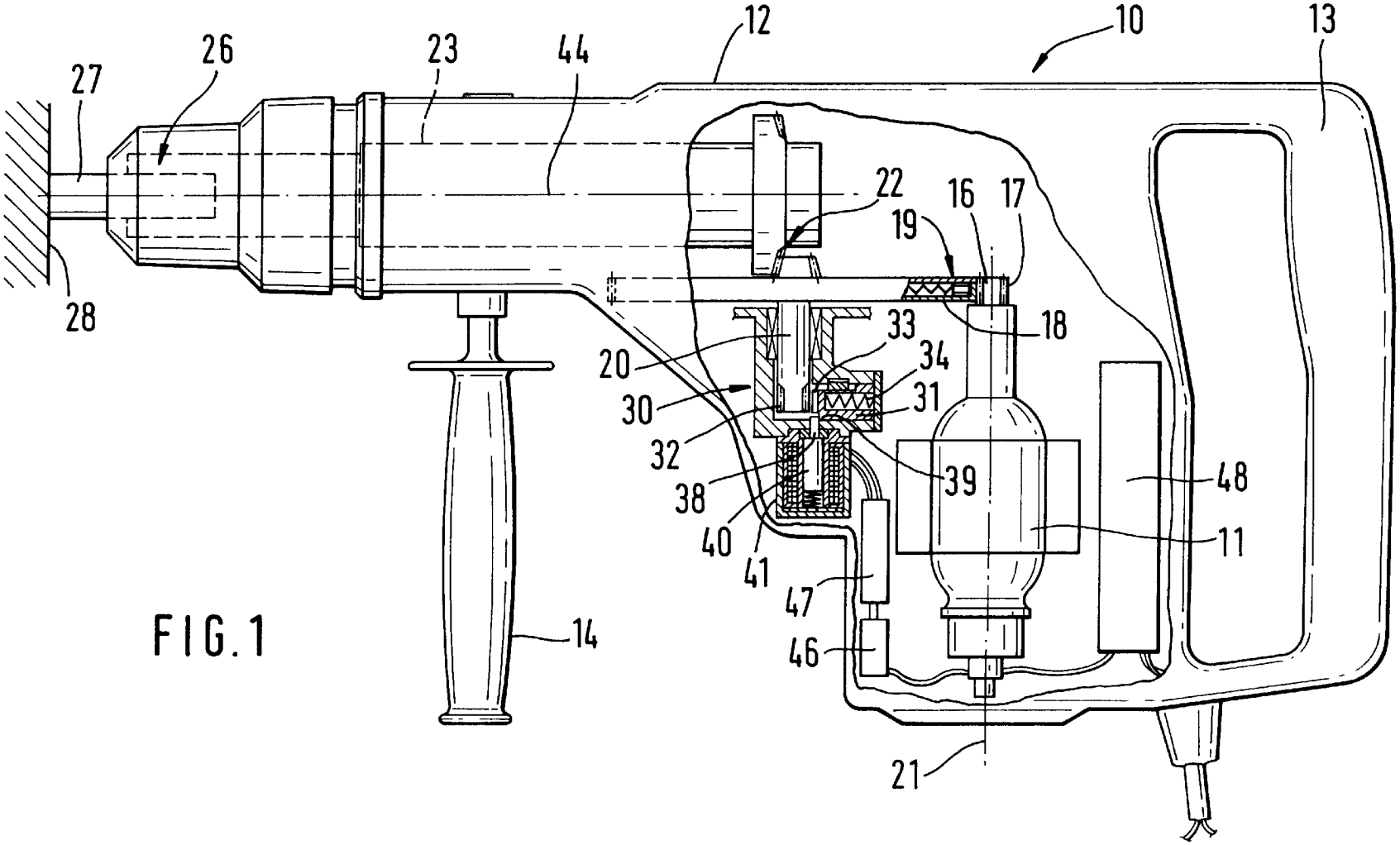
FIG. 1 is a longitudinal section of a drilling tool in accordance with a first embodiment.

FIG. 1 is a view showing a hand power tool which in this embodiment is a drilling implement 10. The drilling implement 10 has an electric drive motor 11 arranged in a machine housing 12. The drive motor 11 has a motor shaft 16 rotatable about a motor axis 21. A handle 13 and an auxiliary handle 14 are provided on the machine housing 2.

A drive moment taken from the drive motor 11 is transmitted by a pinion 17 seating on the motor shaft 16 to a toothed gear, and then transmitted from it through an overloading coupling 19 to an intermediate shaft 20. The intermediate shaft 20 located substantially parallel to the motor axis 21 is in a transmission connection with a drilling spindle 23 through a bevel gear transmission 22. The drilling spindle 23 is provided at a side with a tool receptacle 26 for a drilling tool 27 which operates for machining of a work piece 28. The motor shaft 16, pinion 17, toothed gear 18, overloading coupling 19, intermediate shaft 20 and drilling spindle 23 together form a drive train for rotatably driving the tool receptacle 26 or the tool 27 received in it. The machine housing 12 and the drilling spindle 23 can additionally receive a not shown impact mechanism, so that the drilling implement 10 can be also used as an impact drilling machine or a drill hammer.

A blocking device 30 for the drive train of the drilling tool 10 is arranged in the machine housing 12. The blocking device 30 has a locking member 31 which is axially guided relative to the machine housing 12. The locking member 31 is provided at one side with a locking tooth 33 which can engage in a corresponding locking toothing 32 in the intermediate shaft 20. The locking member 31 is displaced by a spring 34 in direction to the locking toothing 32.

A locking pin 38 which is displaceable substantially perpendicularly to the displacement direction of the locking member 31 engages behind a shoulder projection 39 on the locking member 31 and serves as an abutment for the locking member 31. Therefore, the locking tooth 33 remains out of the engagement of the locking toothing 32. The locking pin 38 is provided with a cylindrical expansion 37 which forms an armature 40 of an electromagnet 41.

In operation of the drilling implement 10, the operator holds it by the handle 13 or in some cases also additionally by the auxiliary handle 14. The operator must therefore counteract a torque which engages the tool 27 and acts around the drilling spindle axis 44. When during the operation the tool 27 is fixed in the workpiece 28, the drilling implement 10 obtains an impact-like acceleration around the drilling spindle axis 44. Thereby the drilling implement 10 can jump from the hand of the operator and cause injuries to people or damages to the drilling implement 10.

Such an uncontrolled blocking case is detected by a sensor 46. The sensor 46 is formed for example as an acceleration pick-up. The signal produced by the sensor 46 is monitored in an evaluating device 47. When a predetermined threshold value is exceeded, the evaluating device 47 activates the electromagnet 41, and its armature 40 is pulled against the spring force 42. The locking pin 38 is pressed out of the shoulder projection 39 and releases the locking member 31 for engagement into the locking toothing 32.

With the form-locking engagement of the locking tooth 33 in the locking toothing 32, the drive train is blocked in an impact-like way relative to the machine housing 12. Simultaneously, the drive motor 11 can be turned off via a motor control 48. In this case an excessive drive moment can be reduced by the overloading coupling 19 which can be formed as a separating coupling.

Figure 2:
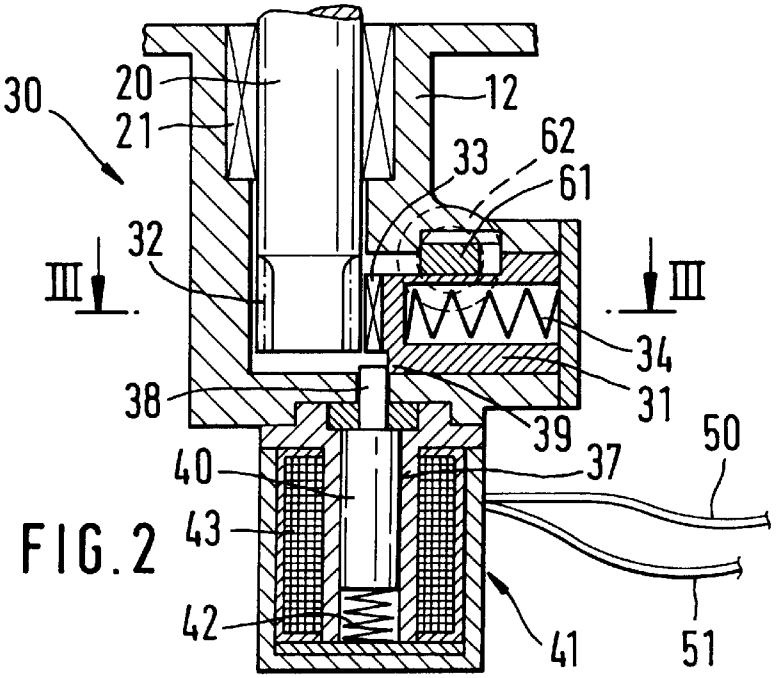
FIG. 2 is a view showing a section of a blocking device of the drilling tool of the invention.

The blocking device 30 is shown in FIG. 2. It can be seen that the intermediate shaft 20 is rotatably received in the machine housing 12 through a bearing 21. The locking toothing 33 is provided at the end side in the intermediate shaft 20, and the locking member 31 can engage with its locking tooth 31 into the locking toothing 33. The spring 34 brings the locking member 31 with its shoulder projection 39 in abutment against the locking pin 38. The locking pin 38 is displaced by a pressure spring 42 in direction toward its locking position. The armature 40 is surrounded partially by a winding 43. After applying an electrical action to the winding 43 through terminals 50, 51 the armature 40 is pulled axially against the force of the spring 42.

Figure 3:
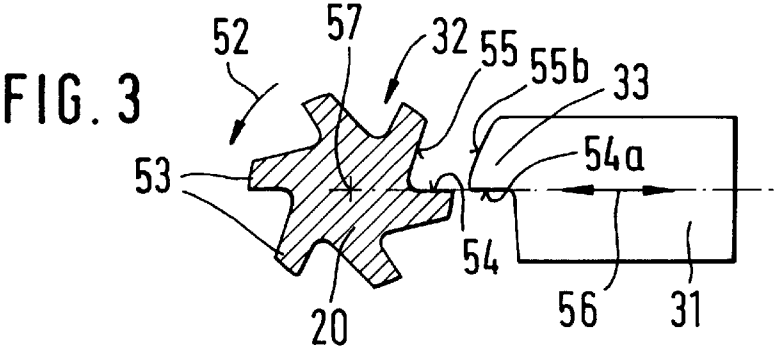
FIG. 3 is a view showing the section taken along the line III—III.

The locking toothing 32 of the intermediate shaft 20 is shown in FIG. 3. The locking toothing 33 is composed of six teeth 53 which extend radially outwardly and are inclined in a rotary direction 52. The teeth 53 have a substantially radially oriented locking surface 54 and a free surface 55. The corresponding locking tooth 33 of the locking member 31 is provided with a corresponding locking surface 54*a* and a corresponding free surface 55*b*. The locking surface 54*a* of the locking tooth 33 is oriented substantially parallel to a displacement axis 56 of the locking member 31, which is located substantially at a right angle to a rotary axis 57 of the intermediate shaft 20. Because of the right-angled arrangement of the displacement direction 56 and the rotary axis 57, a fast working engagement without undesired overarresting of the locking tooth 33 in the locking toothing 32 is possible.

Figure 4:
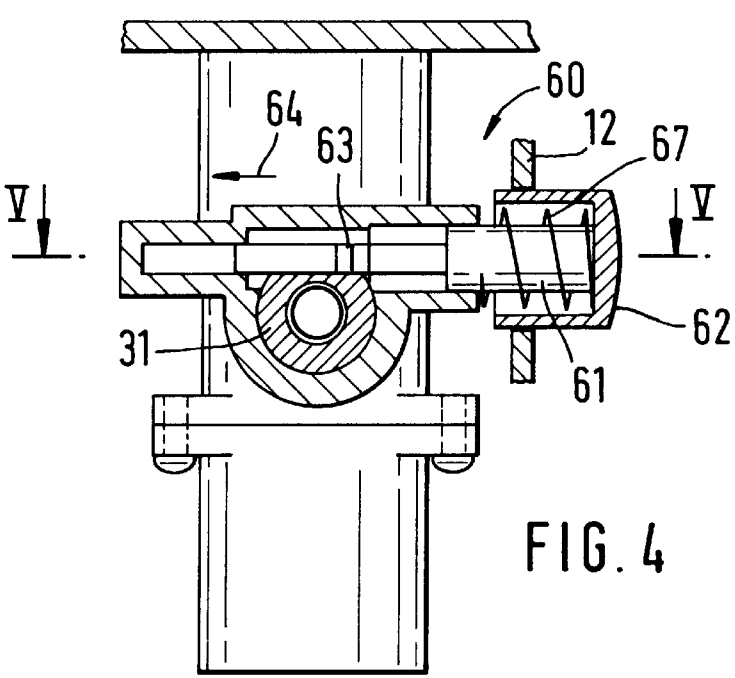
FIG. 4 is a view showing a cross-section through the blocking device in accordance with the present invention.
Figure 5:
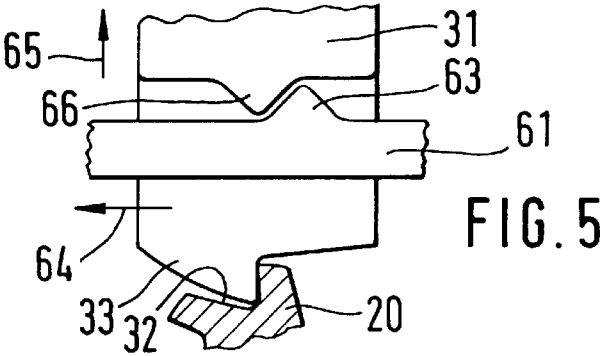
FIG. 5 is a section taken along the line V—V in FIG. 4.

FIG. 4 shows a restoring device 65 the locking member 31. The restoring device 60 has a longitudinally displaceably restoring slider 61 which is fixedly connected at one side with an actuation button 62. The actuation button 62 extends outwardly from the machine housing 12 and therefore can be actuable by the operator of the drilling implement 10 from outside. The restoring slider 61 is provided with a restoring cam 63 which extends substantially perpendicular to the actuation direction of the restoring slider 61 and substantially in the restoring direction of the locking member 31. When the locking tooth 33 of the locking member 31 is in engagement with the locking toothing 32, the locking member 31 is returnable by pressing of the actuating button 62 and thereby by the longitudinal displacement of the restoring slider 61. The restoring cam 63 during actuation of the restoring slider 61 in the actuation direction 64 comes to abutment against a corresponding cam 66 which is formed on the locking member 31 as shown in FIG. 5. During further actuation of the restoring slider 61, the cams 63, 66 slide on one another, and the locking member 31 is displaced in the restoring direction 65 against the force of the spring 34 so that the locking tooth 33 runs completely from the locking toothing 32. The height of the cams 63, 66 is selected so that the shoulder projection 39 can again engage behind the locking pin 38 and the locking member 31 can again come to abutment against the locking pin 38. The restoring slider 61 is simultaneously withdrawn by restoring spring 67 to the initial position shown in FIG. 4. The blocking device 40 of the drilling device 20 is thereby made ready for a further release.

Figure 6:
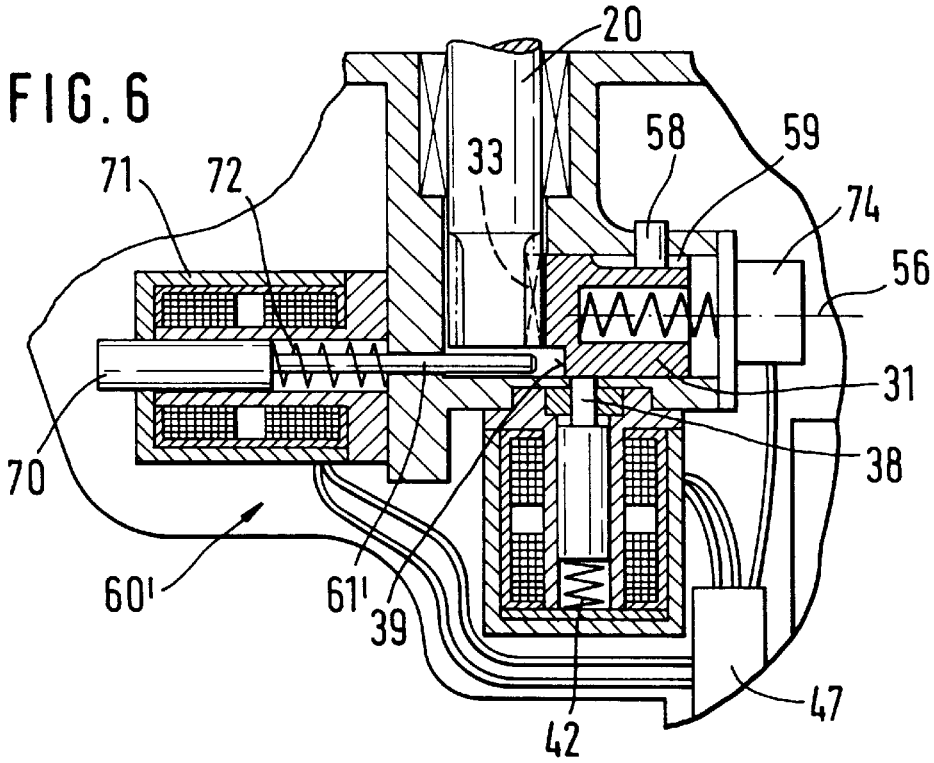
FIG. 6 is a view showing a longitudinal section through a blocking device in accordance with a second embodiment.

The second embodiment shown in FIG. 6 is different from the first embodiment by the restoring device 60. The same and identically operated parts which also are provided in the third embodiment are identified with the same reference numerals.

The drilling implement 10 shown in FIG. 6 is provided with an automatic restoring device 60'. The restoring device 60' has a restoring slider 61' which is located axis-parallel to the displacement axis 56 of the locking member 31. The restoring slider 61 is connected with an armature 70 of an electromagnet 71. The electromagnet 71 is formed as a ring magnet which concentrically surrounds the armature 70. The armature 70 is prestressed by a spring 72 in the displacement direction of the locking member 31 and forced in an axial position with a small magnetic overlap. When the electromagnet 71 is electrically activated, the armature 70 is pulled opposite to the spring 72. The restoring slider 61' moves opposite to the engaging direction of the locking member 31 from it and displaces its locking tooth 33 from the locking toothing 32. The locking member 31 is displaced so far until the locking pin 38, under the action of the spring 42, can engage behind the shoulder projection 39 on the locking member 31. The blocking device 30 is again brought to the initial position. For the purpose of illustration, in FIG. 6 the restoring slider 61' and the blocking pin 38 are shown in one plane. However, actually they are located in different planes so as not to interfere during operation.

A pin 58 engages in a longitudinal groove 59 in the locking member 31 and prevents turning of the locking tooth 33 relative to the locking toothing 32, so that a blocking engagement is always possible. The securing against co-rotation is performed in a different manner, for example by a four-cornered shape of the locking member 31. A position sensor 74 monitors the adjusting position of the locking member 31. When the locking member 31 is located in its initial position, this is recognized by the position sensor 74, and the electromagnet 71 is turned off by the evaluating device 47 so that the spring pulls back the restoring slider 61 to its initial position. The position sensor 74 can be also used for monitoring the blocking position of the locking member 31 so that after reaching the blocking position a turning-off signal produced by it turns off the drive motor 11.

Figure 7:
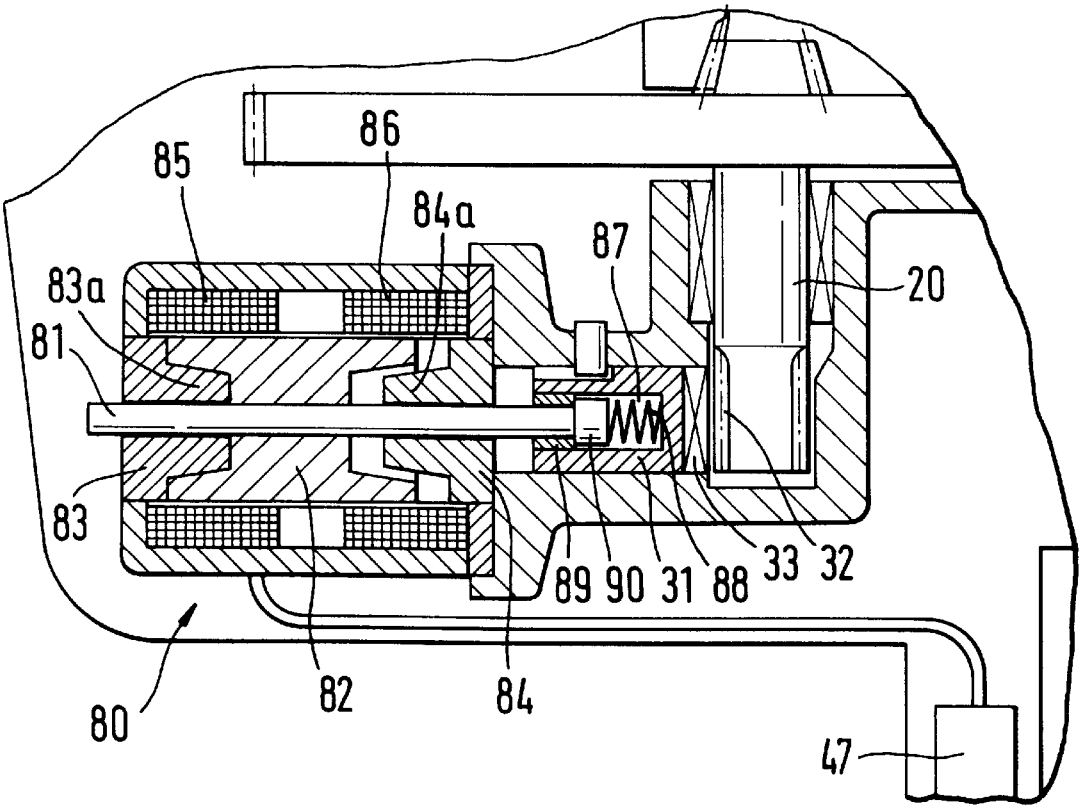
FIG. 7 is a view showing a longitudinal section of a blocking device in accordance with a third embodiment of the present invention.

In the third embodiment shown in FIG. 7, the both electromagnets 41, 71 of FIGS. 6 are replaced by a signal magnet plate 80. A separate restoring device 65, 65' is therefore not necessary. The magnet plate 80 has two permanent magnets 83, 84 located at an end side and opposite to one another. They are provided with overlapping projections 83*a*, 84*b* between which an armature 82 is displaceably supported. The overlapping projections 83*a*, 83*b* form an opposite end position for the armature 82. Moreover, the armature 82 is surrounded by two ring-shaped coils 85, 86. When the armature 82 is supplied with current they are set in one or another end position. When the coils 85, 86 are not supplied with current, one of the oppositely directed pulling forces of the permanent magnet 83, 84 prevails, so that two stable end positions are produced for the armature 82.

The locking member 31 is provided at the rear side with a receiving opening 87 which receives an armature rod 81 connected with the armature 82. The armature rod 81 engages with axial play in the receiving opening 87. A pressure spring 88 is arranged between the armature rod 81 and the locking member 31 and forces the locking member 31 away from the armature rod 81 in direction to the locking toothing 32. The locking member 31 is axially secured by an inner ring 89 which cooperates with a ring collar 20 of the armature rod 81.

In FIG. 7 the armature rod 81 with the locking member 31 is located in its disengaged position. By actuation of the electromagnets 85, 86, the armature 82 can be brought by blocking the intermediate shaft 20 into its opposite end position located near the intermediate shaft 20. The pressure spring 88 guarantees that the armature 83, independently from the penetration depth of the locking tooth 33 into the locking toothing 32, always reaches its end position in which it develops a high holding force.

It will be understood that each of the elements described above, or two or more together, may also find a useful application in other types of constructions differing from the types described above.

While the invention has been illustrated and described as embodied in hand power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand power tool, comprising a machine housing; a drive motor accommodated in said machine housing; a drive train connected with said drive motor and provided with a tool receptacle for rotation of a tool insertable in said tool receptacle; detecting means for detecting an uncontrolled operation of the hand power tool by detecting a blocking of the tool in a workpiece with a resulting impact-like turning of said housing; blocking means provided for said drive train and releasable by said detecting means, said blocking means having a locking toothing arranged in said drive train and a blocking member movably supported in said machine housing and form-lockingly engageable in said locking toothing so as to non-rotatably fix said drive train relative to said machine housing, said detecting means being formed so that said detecting means produces an electrical release signal in an uncontrolled operation, said blocking means being releasable by said electrical release signal; and electromagnet means actuatable by said release signal so that said blocking member is engageable by said electromagnet means into said locking toothing.

2. A hand power tool as defined in claim 1, wherein said blocking member is directly arrestable in said locking toothing by said electromagnet means actuatable by said release signal.

3. A hand power tool as defined in claim 1, wherein said blocking member is indirectly arrestable in said locking toothing by said electromagnet means actuatable by said release signal.

4. A hand power tool as defined in claim 1, wherein said blocking member has one side provided with a locking tooth engageable with said locking toothing, said blocking member being radially displaceable relative to said locking toothing so that said locking tooth by displacement of said blocking member is engageable with and disenageable from said locking toothing.

5. A hand power tool as defined in claim 4, wherein said locking toothing has several teeth each having a locking surface facing in a rotary direction and a free surface facing in another direction, said locking surface being oriented substantially radially outwardly and said free surface being inclined tangentially to said locking surface.

6. A hand power tool as defined in claim 1, wherein said drive train has an intermediate shaft, said locking toothing being provided on said intermediate shaft.

7. A hand power tool as defined in claim 6, and further comprising a separating coupling arranged before said intermediate shaft as considered in a driving direction, said separating coupling automatically separating a driven part of said drive train from said drive motor in response to a signal of said detecting means.

8. A hand power tool as defined in claim 7; and further comprising a separating coupling arranged before said intermediate shaft as considered in a driving direction, said separating coupling automatically separating a driven part of said drive train from said drive motor after engagement of said blocking member in said locking tooth.

9. A hand power tool as defined in claim 6; and further comprising a separating coupling arranged before said intermediate shaft as considered in a driving connection, said separating coupling automatically separating a driven part of said drive train from said drive in response to a signal of said detecting means and after engagement of said blocking member into said locking toothing.

10. A hand power tool as defined in claim 9, and further comprising restoring means for restoring said blocking member from a blocking position to an initial position.

11. A hand power tool as defined in claim 10, wherein said restoring means has a hand-actuated restoring slider provided with a restoring cam and extending substantially perpendicularly to an actuation direction of said restoring means in a restoring direction of said blocking member, and a projection provided on said blocking member with which said restoring slider cooperates.

12. A hand power tool as defined in claim 11, wherein said restoring means has an electromagnet for actuation of said restoring slider.

13. A hand power tool as defined in claim 1, wherein said locking means has a shoulder projection; and further comprising a spring which pre-stresses said blocking member in an engaging direction; a locking pin provided in said electromagnet means and engageable in a displacement path of said blocking member and engageable with said shoulder projection of said blocking member, so that said locking member is then holdable by said blocking pin out of engagement with said locking toothing, and for release of said blocking member, said locking pin being actuatable in response to the electrical release signal of said detection means.

14. A hand power tool as defined in claim 13; and further comprising a further spring which prestresses said locking pin in direction to an engaging position with said locking member.

15. A hand power tool as defined in claim 1; and further comprising a magnet plate, said blocking member being directly engagable with and disengageable from said magnet plate.

16. A hand power tool as defined in claim 15, wherein said magnet plate has two currentless stable end positions.

17. A hand power tool as defined in claim 16; and further comprising permanent magnets which produce said end positions, said magnet plate having an armature; an adjusting member connected with said armature; and two current-actuated coils which reciprocatingly displace said armature between end positions.

18. A hand power tool as defined in claim 17, wherein said blocking member has a locking tooth; and further comprising a spring arranged between said armature and said locking tooth.

* * * * *